US005394800A

United States Patent [19]

Soutome et al.

[11] Patent Number: 5,394,800

[45] Date of Patent: Mar. 7, 1995

[54] PRINTING PLATE LOCKING DEVICE

[75] Inventors: Kazuhiro Soutome, Zama; Masahiko Miyoshi, Ayase, both of Japan

[73] Assignee: Kabushikigaisha Tokyo Kikai Seisakusho, Tokyo, Japan

[21] Appl. No.: 141,688

[22] Filed: Oct. 26, 1993

Related U.S. Application Data

[63] Continuation of Ser. No. 897,400, Jun. 12, 1992, abandoned.

[30] Foreign Application Priority Data

Aug. 8, 1991 [JP] Japan ..... 3-223374

[51] Int. Cl.[6] ..... B41F 27/12

[52] U.S. Cl. ..... 101/415.1; 101/378

[58] Field of Search ..... 101/378, 382.1, 383, 101/415.1, DIG. 36

[56] References Cited

U.S. PATENT DOCUMENTS

| | | | |
|---|---|---|---|
| 3,217,644 | 11/1965 | Schmidt | 101/415.1 |
| 3,626,848 | 12/1971 | Tafel et al. | 101/415.1 |
| 3,685,445 | 8/1972 | Muselik | 101/415.1 |
| 3,757,691 | 9/1973 | Etchell et al. | 101/415.1 |
| 4,100,854 | 7/1978 | Fujishiro et al. | 101/378 |
| 4,104,968 | 8/1978 | Schwaab et al. | 101/415.1 |
| 4,347,788 | 9/1982 | Dufour et al. | 101/415.1 |
| 4,408,530 | 10/1983 | Yano et al. | 101/DIG. 36 |
| 4,493,258 | 1/1985 | Wallschlaeger et al. | 101/415.1 |
| 4,702,166 | 10/1987 | Depa | 101/415.1 |
| 4,890,555 | 1/1990 | Bryer et al. | 101/415.1 |
| 4,938,134 | 7/1990 | Dörsam et al. | 101/378 |
| 5,123,353 | 6/1992 | Beck | 101/415.1 |

FOREIGN PATENT DOCUMENTS

| | | | |
|---|---|---|---|
| 1135119 | 2/1973 | Germany | 101/415.1 |
| 146161 | 1/1981 | Germany | 101/415.1 |
| 262192 | 11/1988 | Germany | 101/415.1 |
| 52-22562 | 6/1977 | Japan . | |
| 103148 | 4/1990 | Japan | 101/415.1 |

*Primary Examiner*—Edgar S. Burr
*Assistant Examiner*—Stephen R. Funk
*Attorney, Agent, or Firm*—Foley and Lardner

[57] ABSTRACT

A printing plate locking device is designed to facilitate clamping a printing plate to and from a plate cylinder in a rotary press without using any external tools. The printing plate device includes a printing plate tensioning device, arranged in the plate cylinder, which can be engaged with one end of the printing plate to tension the printing plate. The printing plate locking device also includes a lever which is operatively connected to the tensioning device; and a retaining device for holding the lever in a holding position when the tensioning device puts tension on the printing plate. A method of clamping the printing plate utilizes the printing plate locking device structure.

13 Claims, 2 Drawing Sheets

PRINTING PLATE LOCKING DEVICE

This application is a continuation of application Ser. No. 07/897,400, filed Jun. 12, 1992, now abandoned.

BACKGROUND OF THE INVENTION

1. Field of the Invention

The present invention generally relates to a printing plate lock-up to facilitate clamping a printing plate to and from a plate cylinder in a rotary press without requiring the use of any tools.

2. Description of the Related Art

In a rotary press, a light printing plate is mounted around the circumferential surface of a plate cylinder and fixed thereon in such a manner that the front and rear folded ends of the printing plate are engaged within a recessed groove formed in the circumferential surface of the plate cylinder. The groove is parallel to the plate cylinder axis, and the printing plate is fastened by a fastening means which is manually driven by a special tool.

A typical conventional device is disclosed in Japanese Patent Publication No. 52-22562, entitled "Light Printing Plate Fixing Device on A Plate Cylinder in Rotary Press", hereinafter referred to as Prior Art 1, and is well known.

In the prior art 1, a recessed groove is formed in the circumferential surface of a plate cylinder in a parallel relationship to its axis. On the other hand, a forward folded end of a printing plate is engaged with one edge of the recessed groove and the printing plate is brought into contact with the plate cylinder so as to cover the circumferential surface of the plate cylinder. The recessed groove further includes a rotatable member urged in a predetermined direction. The rotatable member is forcibly rotated against the urged direction by manual operation using a specially designed tool. Then a rear folded end of the printing plate is inserted in a slit formed in the rotatable member. As the rotatable member is released from its rotated position, the rotatable member is turned by the urging force so that the rear folded end of the printing plate is also subjected to the urged force. Thus, the printing plate is fixed on the plate cylinder.

However, the above described conventional device has various disadvantages, such as for example, manual operation of inserting the specially designed tool into the rotatable member of the plate cylinder. This specially designed tool must always be set near the plate cylinder. Further, an operator may have trouble inserting the specially designed tool and returning it to a waiting position.

BRIEF SUMMARY OF THE INVENTION

Therefore, it is a primary objective of the invention to provide an improved printing plate lock-up mechanism to facilitate clamping a printing plate to and from a plate cylinder in a rotary press without requiring the use of any specially designed tools.

To accomplish the above described objective, a printing plate lock-up mechanism adapted for clamping a printing plate on the circumferential surface of a plate cylinder, comprises a printing plate tensioning means arranged in the plate cylinder, which can be engaged with one end of the printing plate and can tension the printing plate; a lever arranged in linkage with the tensioning means; and a holding means for holding the lever in a holding position where the tensioning means is tensioning the printing plate.

BRIEF DESCRIPTION OF THE DRAWINGS

Other objectives and features of the invention will be apparent from a reading of the following description and the accompanying drawings, wherein.

DETAILED DESCRIPTION OF THE PREFERRED EMBODIMENT

Figure 1:
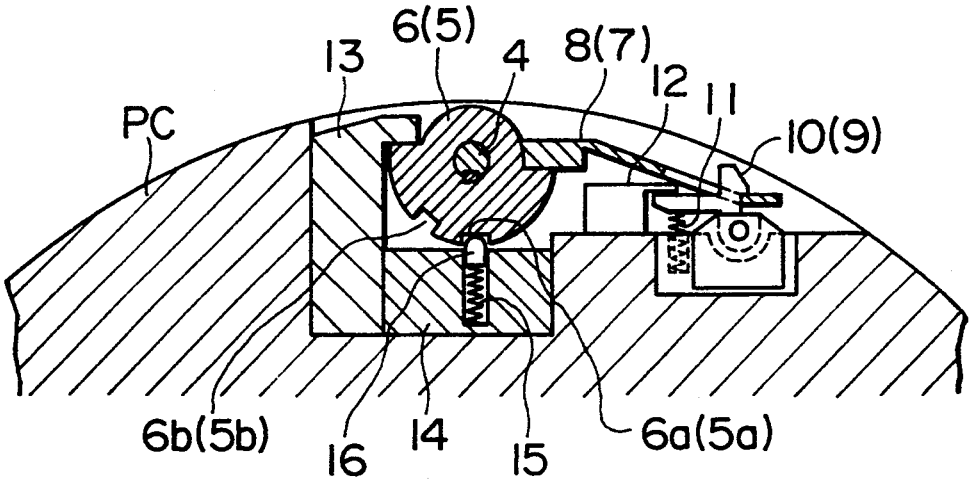
FIG. 1 is an enlarged sectional view, taken along the line 1—1 in FIG. 2, showing an essential portion of a printing plate lock-up mechanism according to the present invention.
Figure 2:
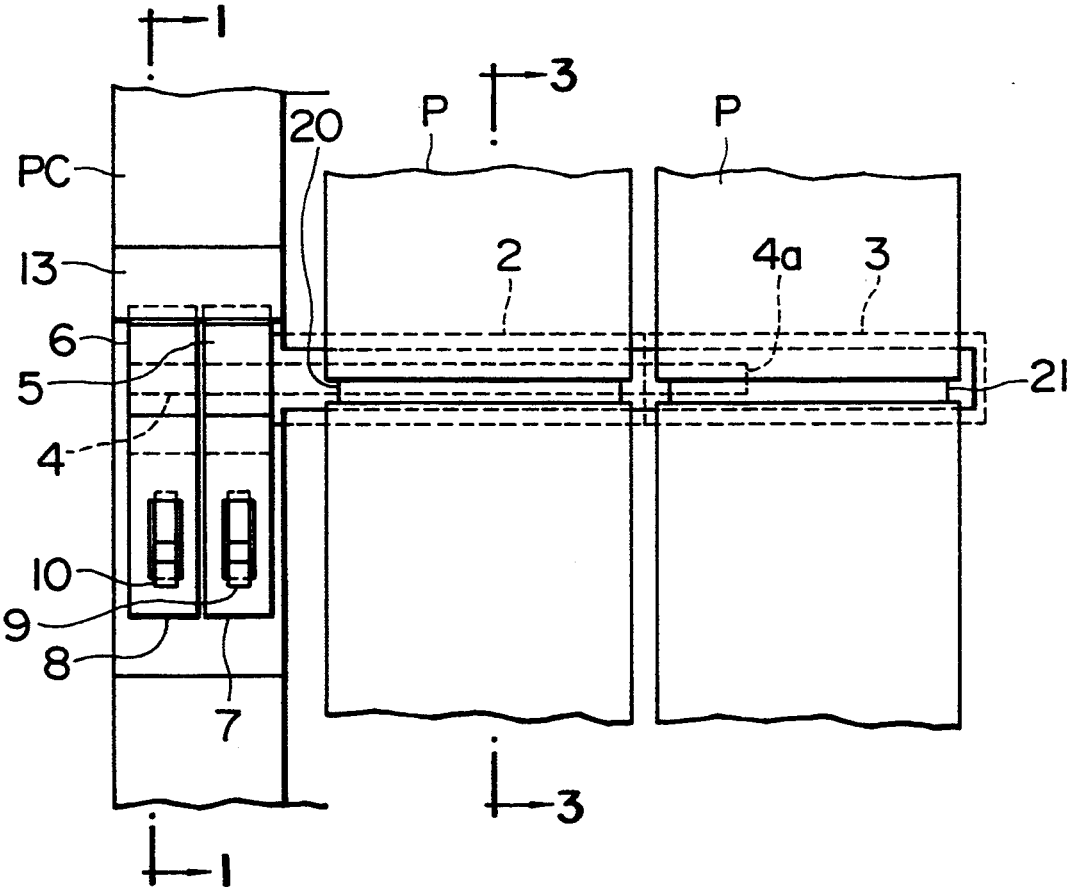
FIG. 2 is a schematical plan view showing the printing plate lock-up mechanism shown in FIG. 1.
Figure 3:
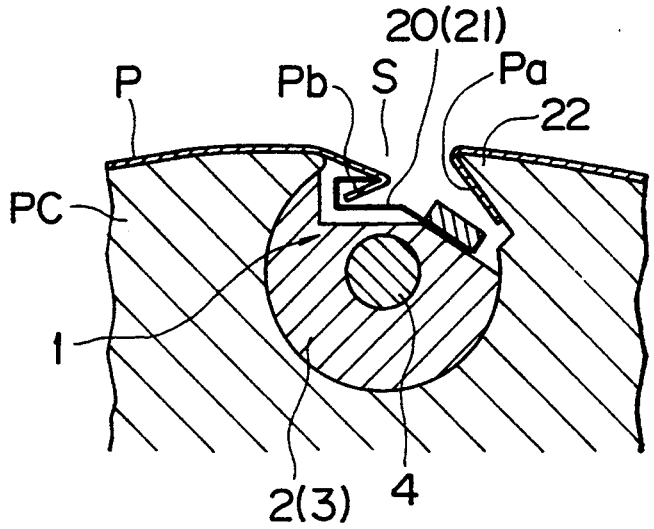
FIG. 3 is a sectional view taken along the line 3—3 shown in FIG. 2.

One preferred embodiment of the present invention will be described in detail with reference to the accompanying drawings FIG. 1 to FIG. 4.

In the drawings, symbols P, Pa, Pb, S and PC represent printing plate, leading edge of the printing plate, trailing edge of the printing plate, recessed groove, and plate cylinder, respectively.

Figure 4:
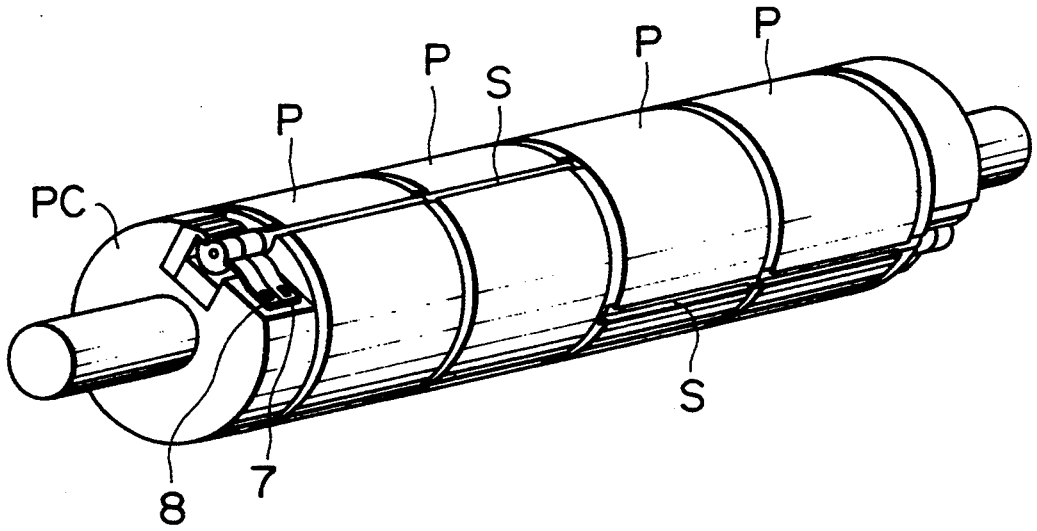
FIG. 4 is a perspective view showing a plate cylinder on which the printing plate lock-up mechanism according to the present invention is assembled.

In a newspaper printing system using a flexible printing plate such as P, the plate cylinder PC is formed with the recessed groove S that runs parallel to the axis of the cylinder PC, as shown in FIG. 4. In the recessed groove S, a printing plate tensioning means 1 including lock-up shafts 2 and 3, and leaf springs 20 and 21. The tensioning means 1 is used to facilitate clamping the printing plate P to the plate cylinder PC. In the groove S, the lock-up shafts 2 and 3 are rotatably supported on a support member, not shown, and limited in their axial movement by the support member.

The lock-up shaft 3 is fixedly connected to one end 4*a* of a center shaft 4 coaxially arranged with the shaft 3. The center shaft 4 is rotatably passed through a hollow space of the lock-up shaft 2 and a ring 5 fixed to the shaft 2. The other end of the center shaft 4 is fixed to another ring 6.

The rings 5 and 6 are respectively provided with positioning notches 5*a* and 5*b*, and 6*a* and 6*b* which are alternatively engaged with a positioning key 16 urged by a spring 15 disposed in a block 14 fixed to the plate cylinder PC.

Further, the rings 5 and 6 are respectively provided with levers 7 and 8 having small openings therein which can be engaged with hooks 9 and 10 as a holding means. When the levers 7 and 8 are held by the hooks 9 and 10, the rings 5 and 6 are prevented from rotating, and also the lock-up shafts 3 and 2 are held in their stationary positions.

The hooks 9 and 10 are pivotably secured to the plate cylinder PC and urged by a spring 11, set in the cylinder PC. Their pivoting movement is limited by a stopper 12 fixed to the plate cylinder PC.

The plate cylinder PC includes another stopper 13 which is in contact with the rings 5 and 6 to limit their rotation.

The lock-up shafts 2 and 3 are fixedly provided with leaf springs 20 and 21 which run parallel to the axis of the shafts 2 and 3. The leaf springs 20 and 21 can be engaged with the rear folded end Pb of the printing plate P. In the recessed groove S an edge member 22 is locked to one longitudinal edge of the groove S. The leading edge Pa of the printing plate P can be engaged with the edge member 2.

A typical clamping operation of the printing plate P to the plate cylinder PC will be described in detail.

First, the leading edge Pa of the printing plate P is engaged with the edge member 22 of the recessed groove S, and the plate P is settled around the circumferential surface of the plate cylinder PC by rotating the cylinder PC itself.

Next, the hook 9 or 10 is pivoted against the urging force of the spring 11 to release the lever 7 or 8 from the engagement with the hook 9 or 10. The ring 5 or 6 is rotated when the lever 7 or 8 is lifted up. The positioning notch **5*b* or 6*b* is engaged with the key 16 to shift lock-up shaft 2 or 3 to its standby position. Then the trailing edge Pb of the printing plate P is set in the recessed groove S, and the lever 7 or 8 is pushed down to engage with the hook 9 or 10. The leaf spring 20 or 21** is engaged with the trailing edge Pb and elastically transformed. The printing plate P is forcibly pulled towards the trailing edge Pb by this elastic force. As a result, the printing plate P is fixed to the circumferential surface of the plate cylinder P.

A releasing operation of the printing plate P will be performed in the reverse process of the above described fixing operation.

As described above, the printing plate locking device according to the present invention does not need any specially designed tools to clamp the printing plate to the plate cylinder. Accordingly, the plate locking operation can be easily and quickly accomplished without any trouble. Further, since specially designed tools are not required, operators can maintain these tools.

Many different embodiments of this invention may be made without departing from the spirit and scope thereof, such that it is understood that the invention is not limited to the specific embodiments and encompasses such embodiments.

What is claimed is:

1. A printing plate locking device for clamping a first printing plate onto a circumferential surface of a plate cylinder, the locking device comprising:

a first tensioning device disposed in the plate cylinder which is engageable with the first printing plate to apply tension to the first printing plate;

a first manually movable lever operatively connected to the tensioning device for moving the first tensioning device into engagement with the first printing plate, said first lever having an opening therein; and a first manually movable retaining device which holds the lever in a holding position at times when the first tensioning device is engaged with and applies tension to the first printing plate thereby preventing a movement of the first lever which would cause disengagement of the tensioning device and the first printing plate;

wherein the first retaining device includes a rotatable hook which engages the opening in the first lever to hold the first lever in the holding position.

2. A locking device as recited in claim 1, further comprising a rotatable shaft which is disposed in the plate cylinder and runs substantially parallel to a rotational axis of the plate cylinder, wherein the first tensioning device is mounted on the rotatable shaft and rotates therewith.

3. A locking device as recited in claim 2, wherein said first tensioning device and said rotatable shaft rotate in the same direction.

4. A locking device as recited in claim 2, wherein the first tensioning device includes a lock-up shaft connected to the rotatable shaft and rotatable therewith.

5. A locking device as recited in claim 4, wherein the first tensioning device further includes a leaf spring having an end portion, the leaf spring is connected to the lock-up shaft and is rotatable therewith, and the end portion of the leaf spring engages with a trailing edge of the first printing plate at times when tension is applied to the first printing plate by the first tensioning device.

6. A locking device as recited in claim 5, wherein the rotatable shaft and the lock-up shaft are each cylindrical in shape.

7. A locking device as recited in claim 2, further comprising a ring having first and second notches and being connected to the rotatable shaft to rotate therewith, and a projecting key, wherein when the lever is moved in a first direction the first notch engages with the projecting key and the first tensioning device engages with the first printing plate to apply tension thereon, and when the first lever is moved in a second direction the projecting key engages the second notch and first the tensioning device becomes disengaged from the first printing plate.

8. A printing plate locking device for clamping a first printing plate onto a circumferential surface of a plate cylinder, the locking device comprising:

a first tensioning device disposed in the plate cylinder which is engageable with the first printing plate to apply tension to the first printing plate;

a first manually movable lever operatively connected to the tensioning device for moving the first tensioning device into engagement with the first printing plate, said first lever having an opening therein;

a first manually movable retaining device which holds the lever in a holding position at times when the first tensioning device is engaged with and applies tension to the first printing plate thereby preventing a movement of the first lever which would cause disengagement of the tensioning device and the first printing plate;

a rotatable shaft which is disposed in the plate cylinder and runs substantially parallel to a rotational axis of the plate cylinder; wherein the first tensioning device is mounted on the rotatable shaft and rotates therewith, and includes a lock-up shaft connected to the rotatable shaft to be rotatable therewith, a leaf spring having an end portion, the leaf spring is connected to the lock-up shaft and is rotatable therewith, the end portion of the leaf spring engages with a trailing edge of the first printing plate at times when tension is applied to the first printing plate by the first tensioning device;

and a rotatable hook which engages the opening in the first lever to hold the lever in the holding position.

9. A locking device as recited in claim 8, further comprising a ring having first and second notches and being connected to the rotatable shaft to rotate therewith, and a projecting key, wherein when the first lever is moved in a first direction the first notch engages with the projecting key and the first tensioning device engages with the first printing plate to apply tension thereon, and when the first lever is moved in a second direction the projecting key engages the second notch and the first tensioning device becomes disengaged from the first printing plate.

10. A locking device as recited in claim 9, further comprising a first stopper which limits rotation of the rotatable shaft, and a second stopper which limits rotation of the rotatable hook.

11. A locking device as recited in claim 10, further comprising first and second biasing springs, wherein the first biasing spring biases the projecting key toward the ring and the second biasing spring biases the rotatable hook toward the opening in the first lever.

12. A method for clamping a printing plate on a circumferential surface of a plate cylinder having an opening therein, a tensioning device deposited in the opening, and a pivotally movable hook, the tensioning device including a rotatable shaft running substantially parallel to a rotational axis of the plate cylinder and being operatively connected to a lever, the method comprising the steps of:

(a) engaging a leading edge of the printing plate with an edge of the opening;

(b) bending the printing plate around the circumferential surface of the plate cylinder;

(b) bending the printing plate around the circumferential surface of the plate cylinder;

(c) moving the lever to rotate the rotatable shaft such that the tensioning device engages a trailing edge of the printing plate and applies tension thereon; and (d) pivoting the hook into engagement with the lever thereby holding the lever and correspondingly the tensioning device in a position whereby the tensioning device applies tension to the printing plate and the lever cannot be moved without disengaging the hook.

13. A printing plate locking device for clamping a first printing plate onto a circumferential surface of a plate cylinder, the locking device comprising:

a first tensioning device disposed in the plate cylinder which is engageable with the first printing plate to apply tension to the first printing plate;

a first manually movable lever operatively connected to the tensioning device, for moving the first tensioning device into engagement with the first printing plate, said first lever having an opening therein;

a first manually movable retaining device which holds the lever in a holding position at times when the first tensioning device is engaged with and applies tension to the first printing plate thereby preventing a movement of the first lever which would cause disengagement of the tensioning device and the first printing plate;

a rotatable shaft which is disposed in the plate cylinder and runs substantially parallel to a rotational axis of the plate cylinder, wherein the first tensioning device is mounted on the rotatable shaft and rotates therewith;

a rotatable lock-up shaft which is disposed in the plate cylinder and which runs substantially parallel to a rotational axis of the plate cylinder, and a second tensioning device disposed in the plate cylinder which is engageable with a second printing plate to apply tension to the second printing plate, said second tensioning device being connected to the rotatable lock-up shaft and being rotatable therewith;

a second lever connected to the second tensioning device for moving the second tensioning device into engagement with the second printing plate; and a second movable retaining device which holds the second lever in a holding position at times when the second tensioning device is engaged with and applies tension to the second printing plate thereby preventing a movement of the second lever which would cause disengagement of the second tensioning device and the second printing plate;

wherein the lock-up shaft has a hollow space running therethrough and the rotatable shaft passes through the hollow space and is rotatable therein such that the first and second tensioning devices are independently movable.

* * * * *